US008866678B2

(12) United States Patent
Abe

(10) Patent No.: US 8,866,678 B2
(45) Date of Patent: Oct. 21, 2014

(54) PATCH ANTENNA DEVICE AND RADIO WAVE RECEIVER

(75) Inventor: Kazuaki Abe, Iruma (JP)

(73) Assignee: Casio Computer Co., Ltd., Tokyo (JP)

( * ) Notice: Subject to any disclaimer, the term of this patent is extended or adjusted under 35 U.S.C. 154(b) by 169 days.

(21) Appl. No.: 13/570,723

(22) Filed: Aug. 9, 2012

(65) Prior Publication Data

US 2013/0038492 A1 Feb. 14, 2013

(30) Foreign Application Priority Data

Aug. 12, 2011 (JP) ..... 2011-176529

(51) Int. Cl.
*H01Q 1/38* (2006.01)
*H01Q 13/10* (2006.01)
*H01Q 9/04* (2006.01)

(52) U.S. Cl.
CPC ..... *H01Q 9/0428* (2013.01)
USPC ..... 343/700 MS; 343/770

(58) Field of Classification Search
CPC ..... H01Q 9/0407; H01Q 9/0427; H01Q 1/38
USPC ..... 343/700 MS, 767, 770
See application file for complete search history.

(56) References Cited

U.S. PATENT DOCUMENTS

| | | | | |
|---|---|---|---|---|
| 7,079,078 | B2 * | 7/2006 | Yuanzhu | 343/700 MS |
| 8,223,082 | B2 * | 7/2012 | Chiang et al. | 343/767 |
| 8,421,678 | B2 * | 4/2013 | Sakiyama et al. | 343/700 MS |
| 2006/0097922 | A1 * | 5/2006 | Mahmoud | 343/700 MS |

FOREIGN PATENT DOCUMENTS

JP 2002-198725 A 7/2002

* cited by examiner

*Primary Examiner* — Hoang V Nguyen
(74) *Attorney, Agent, or Firm* — Holtz, Holtz, Goodman & Chick PC

(57) ABSTRACT

A patch antenna device of the present invention includes a rectangular dielectric plate, a planar emission electrode, a grounding electrode and a power supply member. The planar emission electrode is provided with a slit at each position corresponding to each short side of the rectangular dielectric plate and both slits extend toward an opposing short side each other and arranged symmetrically. A power supply position of the power supply member is deviated from a center of the planar emission electrode so as to obtain circular polarization characteristics. As a result a patch antenna device having a high gain and circular polarization characteristics can be realized by a simple structure.

4 Claims, 7 Drawing Sheets

PATCH ANTENNA DEVICE AND RADIO WAVE RECEIVER

BACKGROUND OF THE INVENTION

1. Field of the Invention

The present invention relates to a patch antenna device and a radio wave receiver having the patch antenna device.

2. Description of Related Art

As a conventional art, a patch antenna device having a patch antenna which a nearly square planar emission electrode is provided on a surface of a rectangular dielectric plate and can receive and send circularly polarized signals is known as disclosed in Patent Document 1 (JP2002-198725A).

Lengths of sides of the planar emission electrode of such a patch antenna device are adjusted such that an axial ratio of the patch antenna corresponds to a frequency of the circularly polarized signals.

SUMMARY OF THE INVENTION

It is an object of the invention to provide a patch antenna device and a radio wave receiver which is adjusted so as to obtain circular polarization characteristics with a high gain by a simple structure.

An embodiment of the present invention to achieve an object is a patch antenna device that includes a rectangular dielectric plate which has long sides and short sides, a planar emission electrode disposed on one surface of the rectangular dielectric plate, a grounding electrode disposed on the other surface of the rectangular dielectric plate and a power supply member electrically connected to the planar emission electrode. The planar emission electrode is provided with a slit at a position corresponding to one short side of the rectangular dielectric plate and a slit at a position corresponding to the other short side of the rectangular dielectric plate. Both slits extend toward an opposing short side each other and arranged symmetrically. A power supply position of the power supply member to supply electric power to the planar emission electrode is deviated from a center of the planar emission electrode so as to obtain circular polarization characteristics.

An embodiment of the present invention to achieve an object is a radio wave receiving device (receiver) provided with the patch antenna device of claim 1 in (on) a body of the device.

DETAILED DESCRIPTION OF PREFERRED EMBODIMENTS

Preferred embodiments of the present invention will be explained with reference to the drawings.

Figure 1:
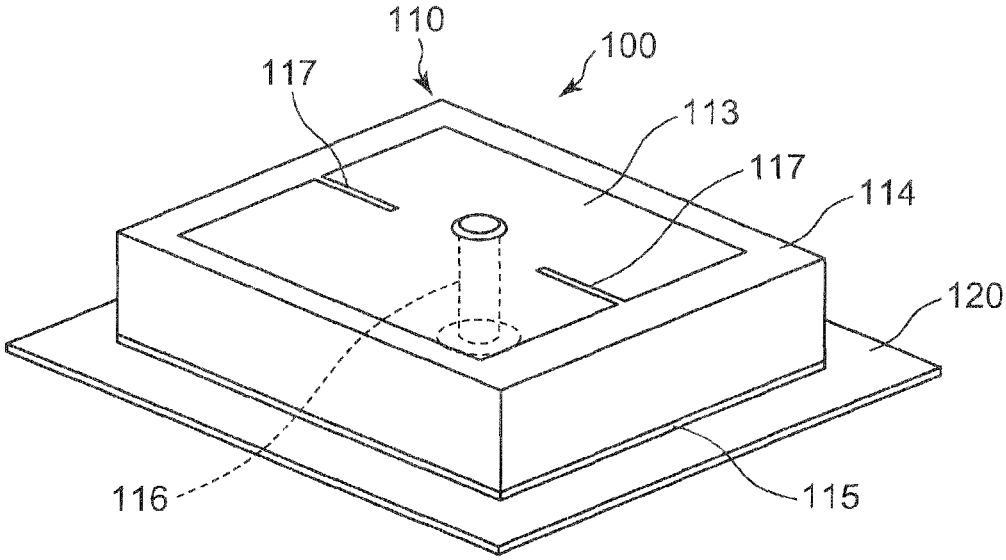
FIG. 1 is a perspective view of a patch antenna device according to a first exemplary embodiment of the present invention.
Figure 2:
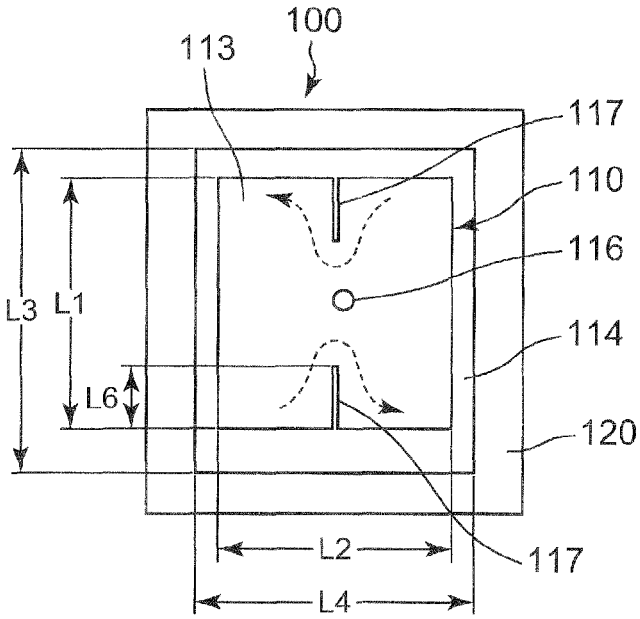
FIG. 2 is a plan view of the patch antenna device shown in FIG. 1.
Figure 3:
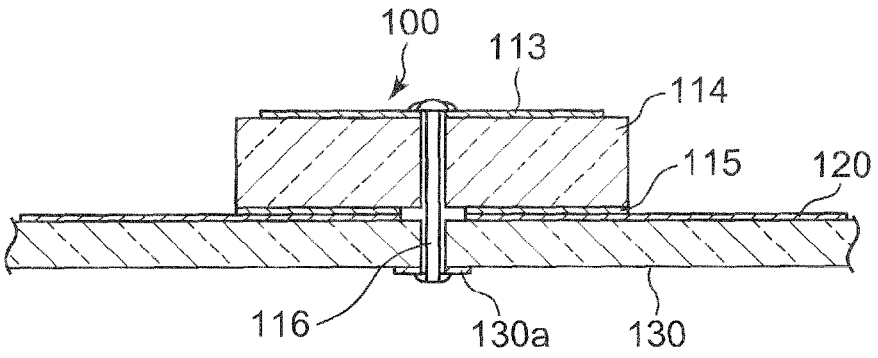
FIG. 3 is a sectional view of a main portion of the patch antenna device in FIG. 1 mounted on a circuit substrate.

A patch antenna device 100 of a first exemplary embodiment is structured as shown in FIGS. 1 to 3 and provided with a patch antenna 110 and a conductive grounding member 120.

The patch antenna 110 includes a rectangular planar (flat) emission electrode 113, rectangular dielectric plate 114, rectangular grounding electrode 115 (see FIG. 3) and power supply member 116.

The dielectric plate 114 has a rectangle shape in a plan view and made of ceramics, for example.

The planar emission electrode 113 is disposed on an upper surface of the dielectric plate 114.

The planar emission electrode 113 has a rectangle shape in a plan view and made of silver foil, metal plate or metal film having a specified thickness, for example.

The planar emission electrode 113 is formed smaller than the dielectric plate 114 in a plan view (see FIG. 2).

A long side of the planar emission electrode 113 is parallel to a long side of the dielectric plate 114 and a short side of the planar emission electrode 113 is parallel to a short side of the dielectric plate 114.

A slit 117 is formed at each of the two opposing short sides of the planar emission electrode 113 in a direction toward the opposite short side.

The opposing two slits 117, 117 are formed symmetrically with respect to a center of the planar emission electrode 113.

The grounding electrode 115 is formed on an undersurface of the dielectric plate 114 as shown in FIG. 3.

The grounding electrode 115 is formed on the whole area of the backside of the dielectric plate 114 except a position of the power supply member 116 and around the position.

This means that an outer shape of the grounding electrode 115 is the same as the rectangular dielectric plate 114.

The grounding electrode 115 is made of silver foil, metal plate or metal film having a specified thickness, for example.

The conductive grounding member 120 is generally larger than the dielectric plate 114 in a plan view, as shown in FIG. 2, and secured by a double faced tape with the grounding electrode 115 of the patch antenna 110.

A shape of the conductive grounding member 120 is not necessarily a square but preferably as large as possible.

The power supply member 116 is provided so as to penetrate both of the conductive grounding member 120 and the dielectric plate 114.

An upper end of the power supply member 116 is electrically connected to the planar emission electrode 113 by soldering.

As shown in FIG. 3, a circuit substrate 130 is provided under the conductive grounding member 120 which corresponds to a GND of the circuit.

A lower end of the power supply member 116 penetrates the circuit substrate 130 and is electrically connected to a transmitter circuit and/or a receiving circuit (both not shown) via a conductive pattern 130*a* formed on an underside of the circuit substrate 130.

In this embodiment a length (L1) of a long side of the rectangular planar emission electrode 113 is 9.5 mm and a length (L2) of a short side is 9.3 mm, respectively.

A length (L3) of a long side of the rectangular dielectric plate 114 is 12 mm, a length (L4) of a short side is 11 mm and a thickness (L5) is 4 mm, respectively.

And a length (L6) of each slit 117 is 2.45 mm. However, these sizes are not restrictive but any sizes can be applicable.

Next, the position of power supply to the patch antenna device 100, the length of the slit 117 and the length of the planar emission electrode 113 will be explained.

A position where the upper end of the power supply member 116 is electrically connected to the planar emission electrode 113 is the power supply position.

Figure 4:
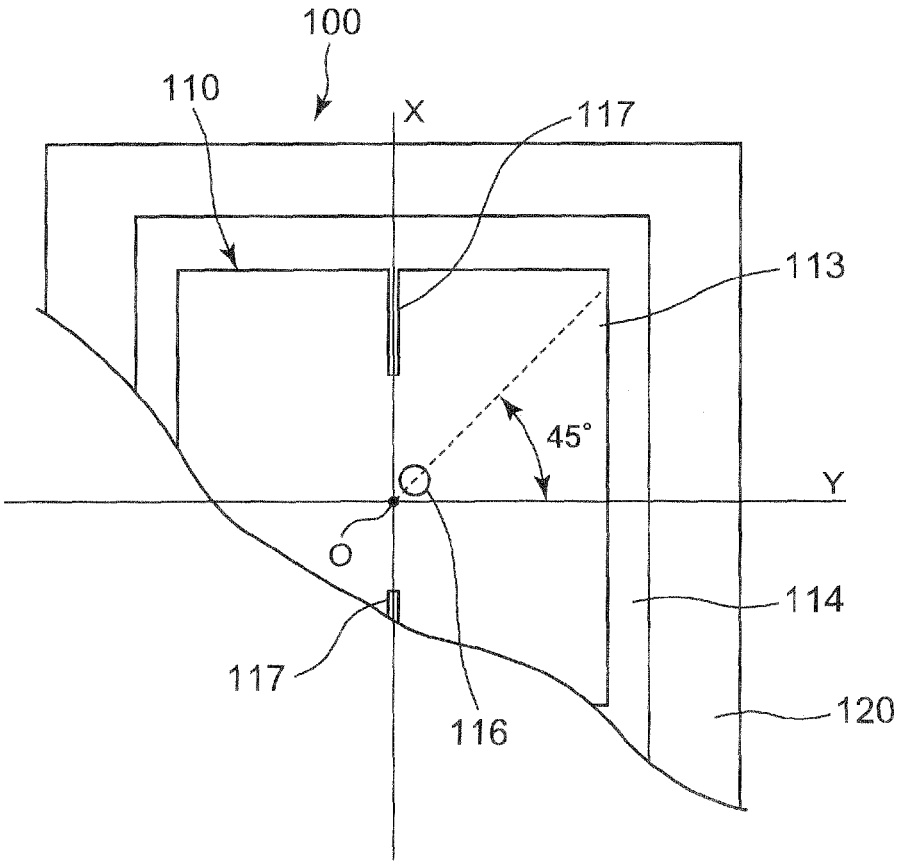
FIG. 4 is a partial plan view of the patch antenna device in FIG. 1 for explaining a power supply position.

As shown in FIG. 4, in an exemplary embodiment, the power supply position is determined at a position on a line that passes through the center (O) of the planar emission electrode 113 and inclined at 45 degrees with respect to an axis (Y axis) parallel to the short side of the planar emission electrode 113, and where an appropriate impedance (50Ω) can be obtained.

The length (L6) of the slit 117 and the lengths (L1, L2) of the planar emission electrode 113 are adjusted such that a phase difference between two resonance frequencies of the patch antenna 110 becomes 90 degrees.

By virtue of the adjustment, the patch antenna device 100 having good circular polarization characteristics can be realized.

Figure 5:
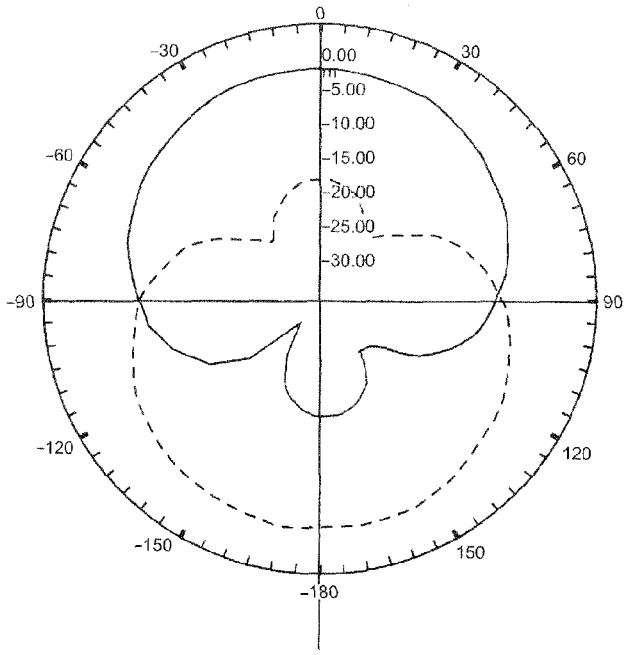
FIG. 5 is a graph showing radio emission characteristics of the patch antenna device in FIG. 1.

FIG. 5 is a graph showing a result of a simulation of the emission characteristics of the patch antenna device 100.

The solid line in FIG. 5 is an antenna gain for a right-handed (clockwise) circularly polarized wave and the dashed line is an antenna gain for a left-handed (counterclockwise) circularly polarized wave (the unit is dBic).

As can be seen by FIG. 5, the right-handed polarization gain becomes high in a vertex direction (0 degree position in FIG. 5) of the antenna and the left-handed polarization gain becomes low in the vertex direction.

A cross polarization discrimination which indicates a capability to discriminate the right-handed polarization and the left-handed polarization is approximately 16 dB.

This is a sufficient capability as a circular polarization antenna.

The patch antenna device 100 structured as above explained results in following effects.

A slit 117 is formed at each of the short sides of the planar emission electrode 113 such that each of the slits extends toward the opposite short side each other and they are positioned symmetrically.

As a result, a resonance frequency in the short side direction (right/left direction in the drawing) among two resonance frequencies of the patch antenna 110 can be changed lower.

In addition the power supply position of the power supply member 116 to the planar emission electrode 113 is determined at a position on a line that passes through the center (O) of the planar emission electrode 113 and inclined at 45 degrees with respect to an axis (Y axis) parallel to the short side of the planar emission electrode 113, and where an appropriate impedance (50Ω) can be obtained.

As a result, it becomes possible to adjust the phase difference of the two resonance frequencies at 90 degrees by changing the lengths of the sides of the planar emission electrode 113 and the length of the slit 117.

Thus the patch antenna device 100 having a high gain and circular polarization characteristics can be structured in a simple way.

In addition, the two slits 117, 117 are formed symmetrically at opposing short sides of the planar emission electrode 113 such that the slits extend toward the center of the planar emission electrode 113. As a result the current flowing in the planar emission electrode 113 takes a detour around the slits 117, 117 as indicated by a dashed line in FIG. 2.

Thus a length of an electric path along the short side direction (right/left direction in the drawing) becomes longer.

It becomes possible to lower the resonance frequency along the short side direction (right/left direction in the drawing) by substantially elongate the length of the current path along the short side direction of the planar emission electrode 113.

As a result it becomes possible to reduce a difference between the resonance frequency along the long side direction (up/down direction in the drawing) and the resonance frequency along the short side direction.

In addition, by forming the two slits 117, 117 symmetrically, the same result as is obtained by substantially elongating the length in the short side direction of the dielectric plate 114 can be obtained. Thus the patch antenna device can be easily mounted on a radio wave receiver having a small thickness.

Second Exemplary Embodiment

Figure 6:
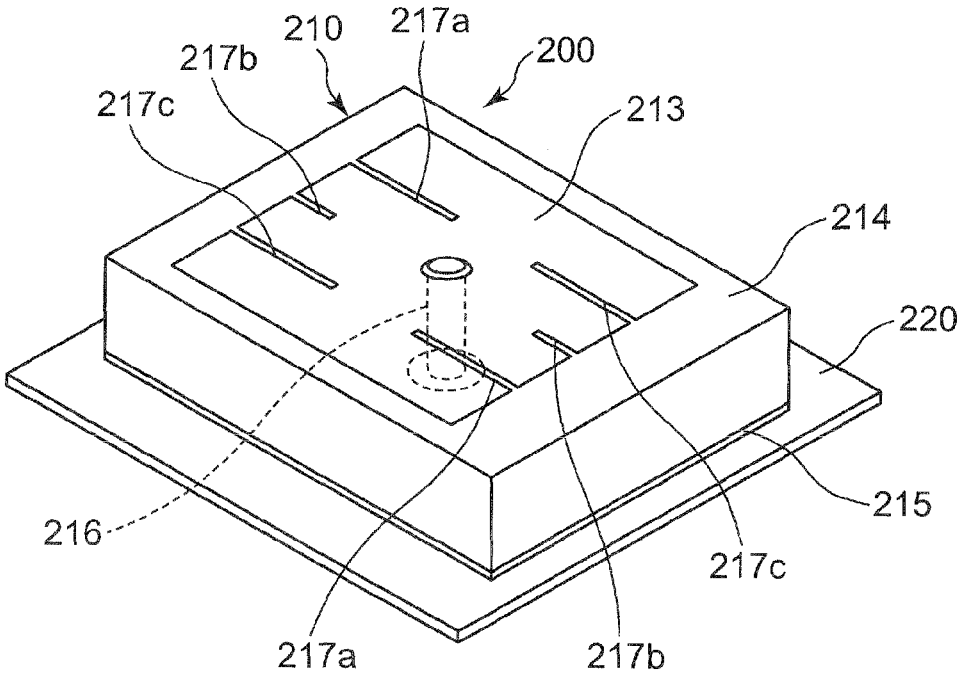
FIG. 6 is a perspective view of a patch antenna device according to a second exemplary embodiment of the present invention.

FIG. 6 is a perspective view of a patch antenna device according to a second exemplary embodiment.

Figure 7:
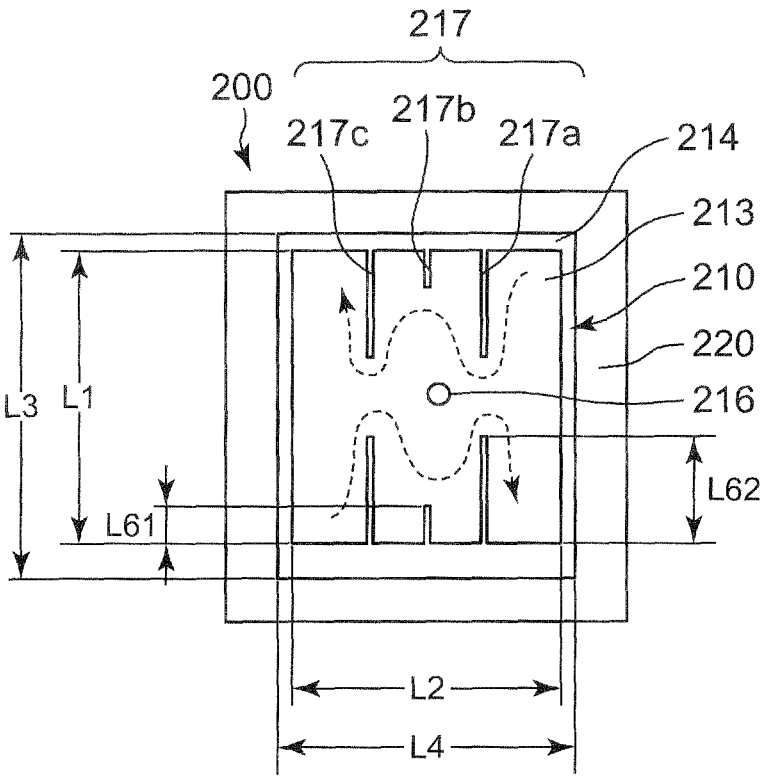
FIG. 7 is a plan view of the patch antenna device shown in FIG. 6.

FIG. 7 is a plan view of the patch antenna device.

Figure 8:
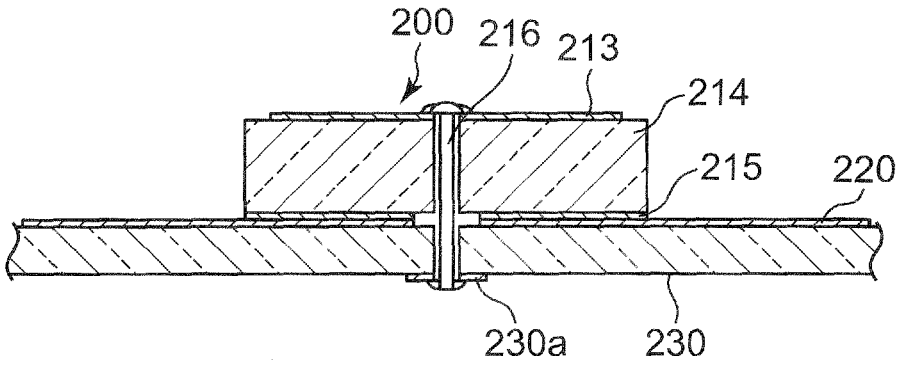
FIG. 8 is a sectional view of a main portion of the patch antenna device in FIG. 6 mounted on a circuit substrate.

FIG. 8 is a sectional view of a main portion of the patch antenna device mounted on a circuit substrate.

The patch antenna device 200 according to a second embodiment has a structure as shown in FIGS. 6 to 8 and is provided with a patch antenna 210 and a conductive grounding member 220.

The patch antenna 210 includes a planar emission electrode 213, dielectric plate 214, grounding electrode 215 and power supply member 216.

The planar emission electrode 213, dielectric plate 214, grounding electrode 215 and power supply member 216 of the patch antenna 210 correspond to the planar emission electrode 113, dielectric plate 114, grounding electrode 115 and power supply member 116 of the patch antenna 110 of a first exemplary embodiment.

A position of power supply, a length of a slit 217 and a size of the planar emission electrode 213 are adjusted by the same manner as a first exemplary embodiment.

The conductive grounding member 220 and a circuit substrate 230 correspond to the conductive grounding member 120 and the circuit substrate 130 of a first exemplary embodiment.

An explanation of the common parts is omitted and different portions will be explained below.

According to the patch antenna device 200, shapes of the planar emission electrode 213 and the dielectric plate 214 are more slender than those of a first exemplary embodiment.

A length (L1) of the long side of the planar emission electrode 213 is almost the same as the length (L1) of the long side of the planar emission electrode 113 of a first embodiment.

On the other hand, a length (L2) of the short side of the planar emission electrode 213 is shorter than the length (L2) of the short side of the planar emission electrode 113 of a first embodiment.

Specifically, according to a second embodiment, the long side length (L1) of the rectangular planar emission electrode 213 is 9.2 mm and the short side length (L2) is 8.4 mm.

The long side length (L3) of the rectangular dielectric plate 214 is 13 mm, the short side length (L4) is 10 mm and the thickness (L5) is 3 mm.

The lengths (L62, l61, L62) of the slits 217*a*, 217*b* and 217*c* are 3.1 mm, 1.2 mm and 3.1 mm, respectively.

However, these sizes are not restrictive but any other sizes may be applicable.

When using the planar emission electrode 213 of the size explained above, it is difficult to lower the resonance frequency along the short side direction (right/left direction in the drawing) even if a slit be formed symmetrically at each short side of the planar emission electrode 213 like the patch antenna 110 of a first embodiment because the short side length (L2) is much shorter than that of a first embodiment.

As a result a difference between the resonance frequency along the short side direction and the resonance frequency along the long side direction becomes large and it becomes difficult to adjust the best axial ratio of the antenna to correspond to a frequency of the circularly polarized signals for transmission/reception.

Therefore, by forming three slits 217*a*, 217*b* and 217*c* at each of the opposing two short sides of the planar emission electrode 213 symmetrically such that the slits have openings at the side and extend toward the opposite short side, a length of the current path along the short side direction is substantially elongated and the difference between the resonance frequency along the short side direction and the resonance frequency along the long side direction is lowered so as to obtain the same antenna characteristics as a first embodiment.

In addition, the length (L61) of the center slit 217*b* is formed shorter than the length (L62) of the other slits 217*a* and 217*c*.

By virtue of the feature the current flowing in the planar emission electrode 213 takes a detour around the three slits 217*a*, 217*b* and 217*c* of different lengths as indicated by a dashed line in FIG. 7 and thus the total length of the current path can be extended compared with the case where the lengths of the three slits are the same.

Because the length of the current path along the short side direction of the planar emission electrode 213 is substantially extended, it becomes possible to reduce the difference between the resonance frequency along the short side direction and the resonance frequency along the long side direction effectively.

According to a second exemplary embodiment, following effects can be obtained.

The patch antenna 210 of the patch antenna device 200 of a second embodiment is more slender than the patch antenna 110 of a first embodiment. Therefore, the patch antenna 210 can be mounted on a more slender casing than that for mounting the patch antenna 110.

Figure 9:
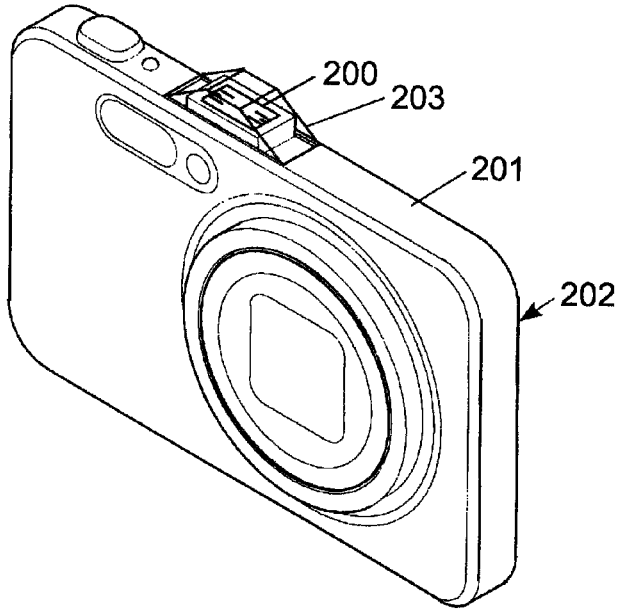
FIG. 9 is a perspective view of a digital camera provided with the patch antenna device of FIG. 6.
Figure 10:
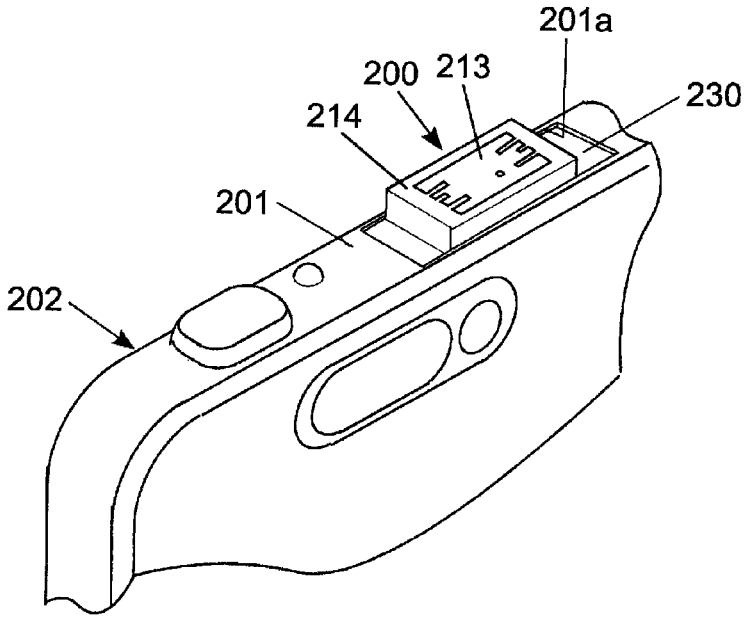
FIG. 10 is a perspective view of an enlarged part of the digital camera of FIG. 9.

FIGS. 9 and 10 show an example of a radio wave receiver which the patch antenna device 200 of a second embodiment is mounted on a body 201.

The radio wave receiver is a digital camera 202.

The digital camera has a thin casing 203 because of the slimming requirement.

The patch antenna device 200 integrated in the casing 203 of the digital camera 202 is mounted on an upper surface of the digital camera 202 such that the short side direction of the dielectric plate 214 becomes parallel to the direction of thickness of the digital camera 202.

The patch antenna device 200 is mounted on a circuit substrate 230 which is exposed at an opening 201*a* of the body 201.

Figure 11:
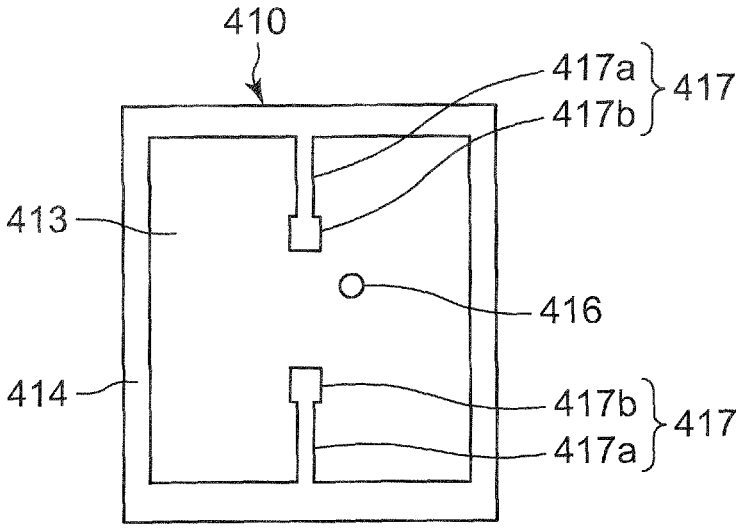
FIG. 11 is a plan view of a first variation of a patch antenna device.

FIG. 11 is a first variation of a patch antenna.

The patch antenna 410 includes a planar emission electrode 413 formed on an upper surface of a rectangular dielectric plate 414 and a grounding electrode (not shown) formed on an undersurface of the dielectric plate 414, and an electric power is supplied to the planar emission electrode 413 via a power supply member 416.

A shape of a slit 417 of the patch antenna 410 is composed of a narrow and linear portion 417*a* and a rectangular (box-shaped) portion 417*b* successively formed at the tip of the linear portion 417*a*.

According to the patch antenna 410, a length of a current path can be extended because the current takes a detour around the rectangular portion 417*b* compared with the case the slit has only the linear portion 417*a*.

Figure 12:
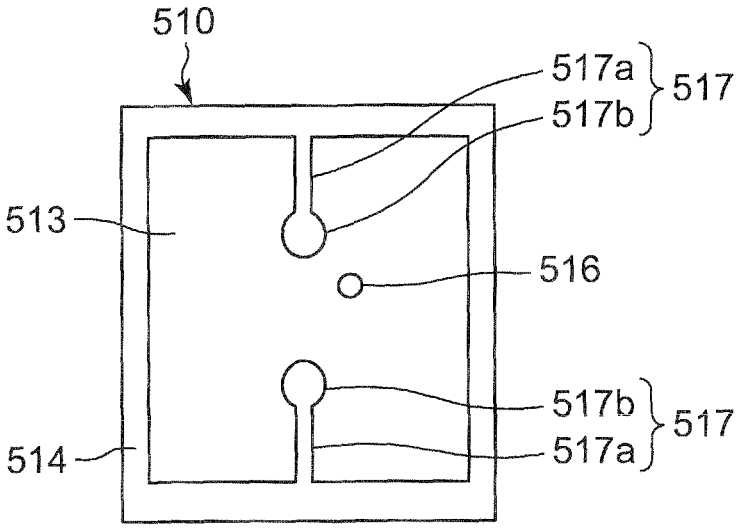
FIG. 12 is a plan view of a second variation of a patch antenna device.

FIG. 12 is a second variation of a patch antenna.

The patch antenna 510 includes a planar emission electrode 513 formed on an upper surface of a rectangular dielectric plate 514 and a grounding electrode (not shown) formed on an undersurface of the dielectric plate 514, and an electric power is supplied to the planar emission electrode 513 via a power supply member 516.

A shape of a slit 517 of the patch antenna 510 is composed of a narrow and linear portion 517*a* and a circular portion 517*b* successively formed at the tip of the linear portion 517*a*.

According to the patch antenna 510, a length of a current path can be extended because the current takes a detour around the circular portion 517*b* compared with the case the slit has only the linear portion 517*a*.

Figure 13:
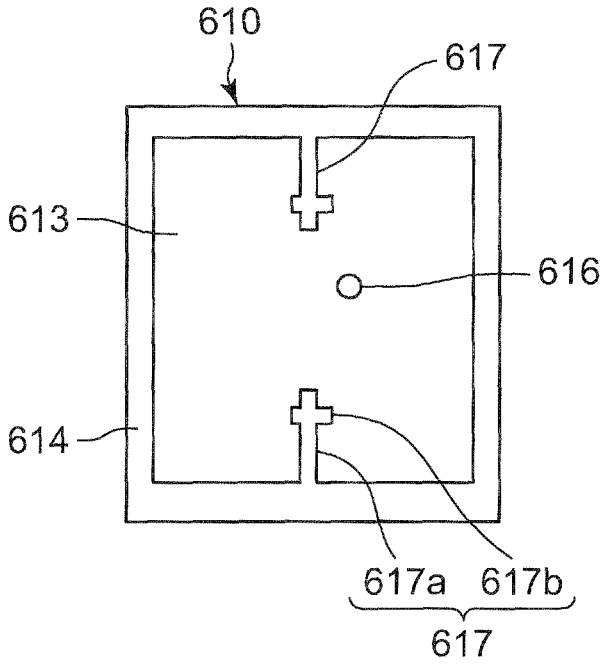
FIG. 13 is a plan view of a third variation of a patch antenna device.

FIG. 13 is a third variation of a patch antenna.

The patch antenna 610 includes a planar emission electrode 613 formed on an upper surface of a rectangular dielectric plate 614 and a grounding electrode (not shown) formed on an undersurface of the dielectric plate 614, and an electric power is supplied to the planar emission electrode 613 via a power supply member 616.

A shape of a slit 617 of the patch antenna 610 is composed of a narrow and linear portion 617*a* and a transverse linear portion 617*b* successively formed at the tip of the linear portion 617*a* and crossing the linear portion 617*a*.

According to the patch antenna 610, a length of a current path can be extended because the current takes a detour around the transverse linear portion 617*b* compared with the case the slit has only the linear portion 617*a*.

It should be noted that the present invention is not limited to the exemplary embodiments and variations above explained but includes the scope of the original claims as well as the present claims and equivalents thereof.

For example, the planar shape of the planar emission electrode is rectangular in the above embodiments and variations. However, the shape may be a square, circle or ellipse.

The shape of the slit may be, as explained in the variations, a combination of a narrow and linear portion and a square portion, a circular portion or a transverse linear portion although the linear slits are explained in the embodiments.

The sizes of the long side and short side of the rectangular planar emission electrode, the sizes of the long side, short side and thickness of the dielectric plate and the lengths of the slits are specified in embodiments. However, they are not limited to the sizes but any sizes can be applicable.

The entire disclosure of Japanese Patent Application No. 2011-176529 filed on Aug. 12, 2011 including specification, claims, drawings and summary are incorporated herein by reference in its entirety.

What is claimed is:

1. A patch antenna device comprising:

a rectangular dielectric plate having long sides and short sides;

a planar emission electrode disposed on one surface of the rectangular dielectric plate;

a grounding electrode disposed on another surface of the rectangular dielectric plate; and a power supply member electrically connected to the planar emission electrode;

wherein:

the planar emission electrode is provided with three slits at a position corresponding to one short side of the rectangular dielectric plate and three slits at a position corresponding to another short side of the rectangular dielectric plate, the slits at each position extending toward an opposing one of the short sides and being arranged symmetrically, the slits at each of the positions are orthogonal to the short sides of the dielectric plate, and a length of a center slit among the three slits at each position is shorter than lengths of the other slits, and a power supply position of the power supply member to supply electric power to the planar emission electrode is deviated from a center of the planar emission electrode so as to obtain circular polarization characteristics.

2. The patch antenna device of claim 1, wherein a shape of the planar emission electrode is selected from a group consisting of a circle, an ellipse and a rectangle each side of which is parallel to a respective side of the dielectric plate.

3. The patch antenna device of claim 1, wherein the planar emission electrode is rectangular, each side being disposed parallel to a respective side of the dielectric plate, and a power supply position of the power supply member to the rectangular planar emission electrode is determined at a position on a line that passes through a center of the rectangular planar emission electrode and inclined at 45 degrees with respect to an axis parallel to the short side of the rectangular planar emission electrode and where an appropriate impedance can be obtained.

4. A radio wave receiving device having the patch antenna device according to claim 1 in a body of the device.

* * * * *